US007014505B1

(12) United States Patent
Tanaka et al.

(10) Patent No.: US 7,014,505 B1
(45) Date of Patent: Mar. 21, 2006

(54) CONNECTOR

(75) Inventors: Tsutomu Tanaka, Yokkaichi (JP); Tsuyoshi Mase, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/075,482

(22) Filed: Mar. 9, 2005

(30) Foreign Application Priority Data

Mar. 9, 2004 (JP) ..... 2004-065451

(51) Int. Cl.
*H01R 12/00* (2006.01)

(52) U.S. Cl. ..... 439/595

(58) Field of Classification Search ..... 439/595, 439/744, 752.5, 752, 603, 594
See application file for complete search history.

(56) References Cited

U.S. PATENT DOCUMENTS 5,240,434 A * 8/1993 Yagi et al. ..... 439/595
5,752,859 A * 5/1998 Abe et al. ..... 439/752
6,244,900 B1 * 6/2001 Ishikawa et al. ..... 439/595
6,375,501 B1 * 4/2002 Kojima ..... 439/595
6,623,313 B1 * 9/2003 Ichida et al. ..... 439/752.5
6,790,085 B1 * 9/2004 Nankou et al. ..... 439/595
6,796,836 B1 * 9/2004 Ichida et al. ..... 439/595
6,817,904 B1 * 11/2004 Ishikawa et al. ..... 439/733.1
6,835,095 B1 * 12/2004 Chen ..... 439/578
6,835,097 B1 * 12/2004 Nankou et al. ..... 439/595
2004/0005821 A1 * 1/2004 Nankou et al. ..... 439/752

* cited by examiner

*Primary Examiner*—Tulsidas C. Patel
*Assistant Examiner*—Harshad C Patel
(74) *Attorney, Agent, or Firm*—Gerald E. Hespos; Anthony J. Casella

(57) ABSTRACT

A terminal fitting (30) has a connecting portion (31) and a stabilizer (41) projects from an outer surface of the connecting portion (31). The stabilizer (41) is received in an insertion groove (18) in an inner wall of a cavity (12) for guiding the terminal fitting (30) into the cavity (12). A lock (11) is provided at the inner wall of the cavity (12) and has a locking section (27) engageable with an engaging surface (40A) of a protrusion (40) and a front edge (39A) of a locking hole (39) provided in the connecting portion (31). An escaping recess (28) is formed in a part of the lock (11) behind the locking section (27) and overlaps the locking section (27) with respect to a width direction. The escaping groove (28) communicates with the insertion groove (18) and receives the stabilizer (41).

11 Claims, 11 Drawing Sheets

CONNECTOR

BACKGROUND OF THE INVENTION

1. Field of the Invention

The invention relates to a connector.

2. Description of the Related Art

U.S. Pat. No. 6,244,900 discloses a connector with a housing that has a cavity and a resilient lock that projects from an inner wall of the cavity. The connector also has a terminal fitting that is inserted into the cavity. A box-shaped connecting portion is provided at a front end of the terminal fitting, and a locking hole is formed in the connecting portion. A locking projection of the lock fits into the locking hole to lock the terminal fitting to lock the terminal fitting in the cavity.

The width of the lock may be increased to increase an area of engagement of the lock with the front edge of the locking hole, and hence to increase a terminal fitting holding force. However, stabilizers project at the rear ends of outer surfaces of connecting portions of some terminal fittings for stabilizing the posture of the terminal fittings. The lock and the stabilizer overlap and interfere with each other if the lock has substantially the same width over its entire length. The connecting portion of the terminal fitting can be widened to move the stabilizer transversely and to avoid interference between the lock and the stabilizer. However, a larger connector with a wider cavity is needed to accommodate the wider connecting portion.

The invention was developed in view of the above problem and an object thereof is to increase a terminal fitting holding force.

SUMMARY OF THE INVENTION

The invention relates to a connector with a housing and at least one cavity in the housing for receiving a terminal fitting. A resilient lock is provided on an inner wall of the cavity and is engageable with the terminal fitting that has been accommodated in the cavity. A stabilizer projects from an outer surface of the terminal fitting and is received in an insertion groove in an inner wall of the cavity for guiding the terminal fitting into the cavity. The lock has a locking section that is engageable with an engaging section of the terminal fitting and an escaping recess that communicates with the insertion groove and permits entry of the stabilizer. The escaping recess is formed at a part of the lock behind the locking section and overlaps the locking section with respect to widthwise direction. Thus, interference with the stabilizer can be avoided, and it is not necessary to widen the connecting portion to avoid interference.

The terminal fitting comprises a connecting portion to be connected with a mating terminal fitting, and the stabilizer projects from an outer surface of the connecting portion.

The locking preferably is engageable with an engaging section of the connecting portion over substantially the entire width. Thus, a terminal holding force increases and there is stronger against shear forces.

The connecting portion preferably is formed into a substantially box shape by bending, folding and/or embossing a conductive plate in the width direction. Thus, projecting plates at the opposite widthwise sides of the connecting portion are placed at least partly one inside the other.

At least the outer projecting plate preferably is formed with a locking hole over the entire width, and a front edge of the locking hole in the outer projecting plate preferably is embossed outward to form a protrusion.

The engaging section preferably includes a rear end of the protrusion and the front edge of the locking hole. Thus, a wide area of engagement can be ensured between the engaging section and the locking section, thereby further increasing the terminal holding force.

The stabilizer preferably projects along a side plate on a lateral edge of a side of the projecting plate behind the locking hole. Thus, the escaping recess allows the stabilizer to escape, and interference with the lock can be avoided without increasing the width of the connecting portion.

The lock preferably is supported at both front and rear ends. Thus, the strength of the lock is enhanced.

A front end of the lock preferably is forked and may be coupled to the opposite inner side surfaces of the cavity.

A locking surface of the locking section and an engaging surface of the engaging section preferably contact each other along an oblique direction intersecting a withdrawing direction of the terminal fitting.

A guiding groove preferably is formed in an inner side surface of the cavity substantially parallel with the insertion groove for receiving the guiding projections.

These and other features and advantages of the invention will become more apparent upon reading the following detailed description of preferred embodiments and accompanying drawings. Even though embodiments are described separately, single features thereof may be combined to additional embodiments.

DETAILED DESCRIPTION OF THE PREFERRED EMBODIMENTS

Figure 1:
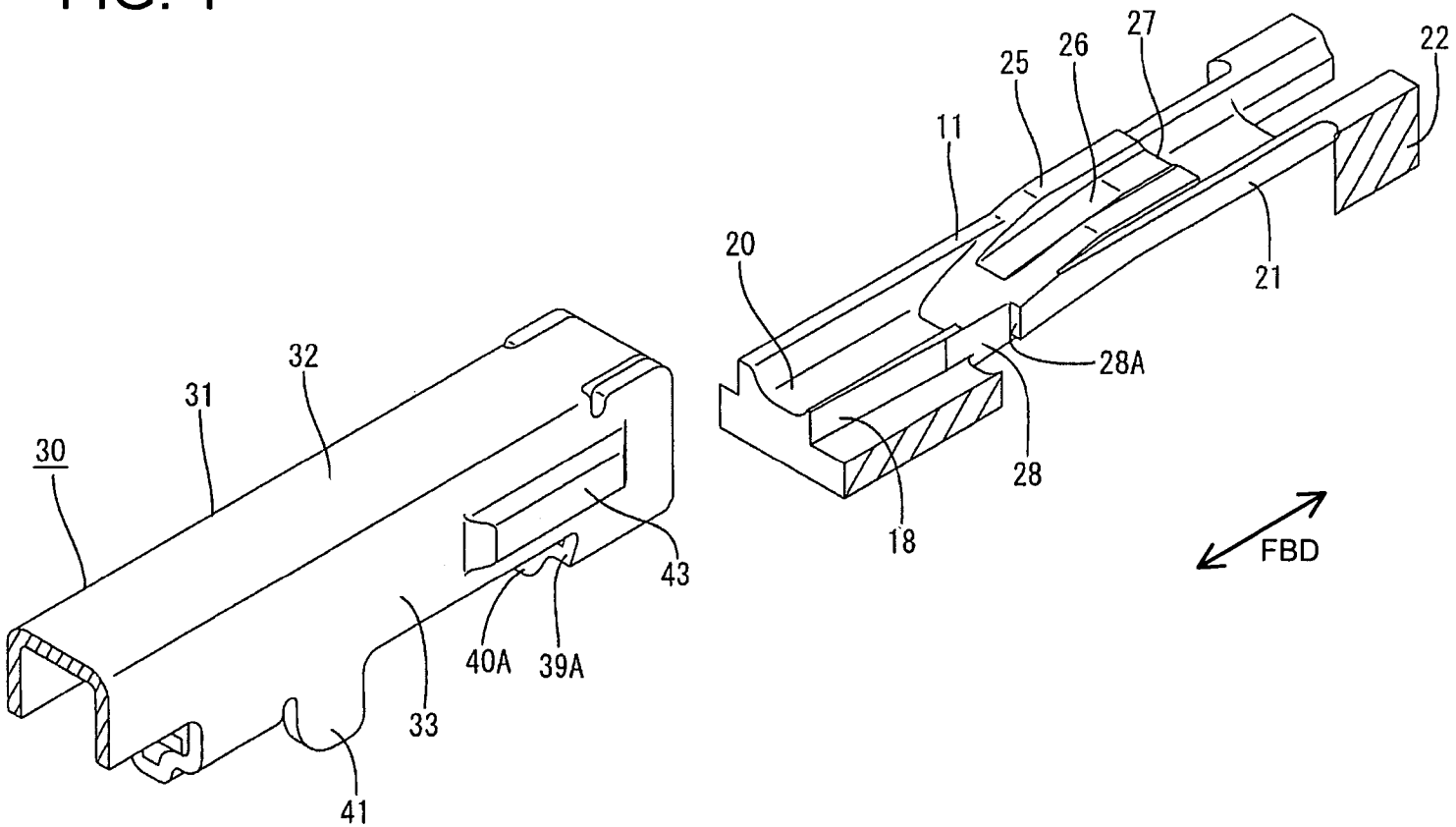
FIG. 1 is an exploded perspective view showing essential portions of a lock and a terminal fitting of a connector according to the invention.

A connector according to the invention is illustrated in FIGS. 1 to 11. The connector has a female housing 10 that is connectable with a mating male connector housing (not shown). The connector also includes female terminal fittings 30 that are connectable with ends of wires W. In the following description, a side of the housing 10 to be connected with the mating housing is referred to as the front concerning forward and backward directions FBD.

Each terminal fitting 30 is formed by stamping or cutting a conductive metal plate into a specified shape and then bending, folding or embossing the metal plate shown in FIGS. 7 to 11. The terminal fitting 30 has a substantially box-shaped connecting portion 31 that is hollow in forward and backward directions FBD and a barrel 46 that is coupled behind the connecting portion 31. The barrel 46 includes front crimping pieces 47 that are configured to be crimped, bent or folded into connection with a core 91 of the wire W and rear crimping pieces 47 that are configured to be crimped, bent or folded into connection with an insulation coating 92 of the wire W.

Figure 10:
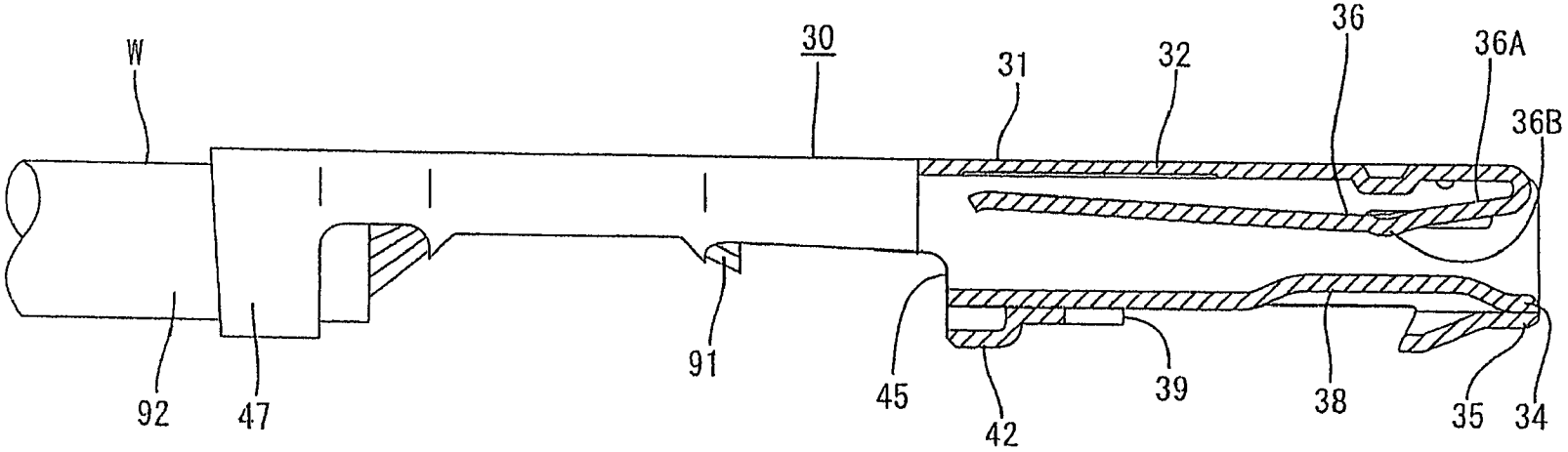
FIG. 10 is a side view in section of the terminal fitting.
Figure 11:
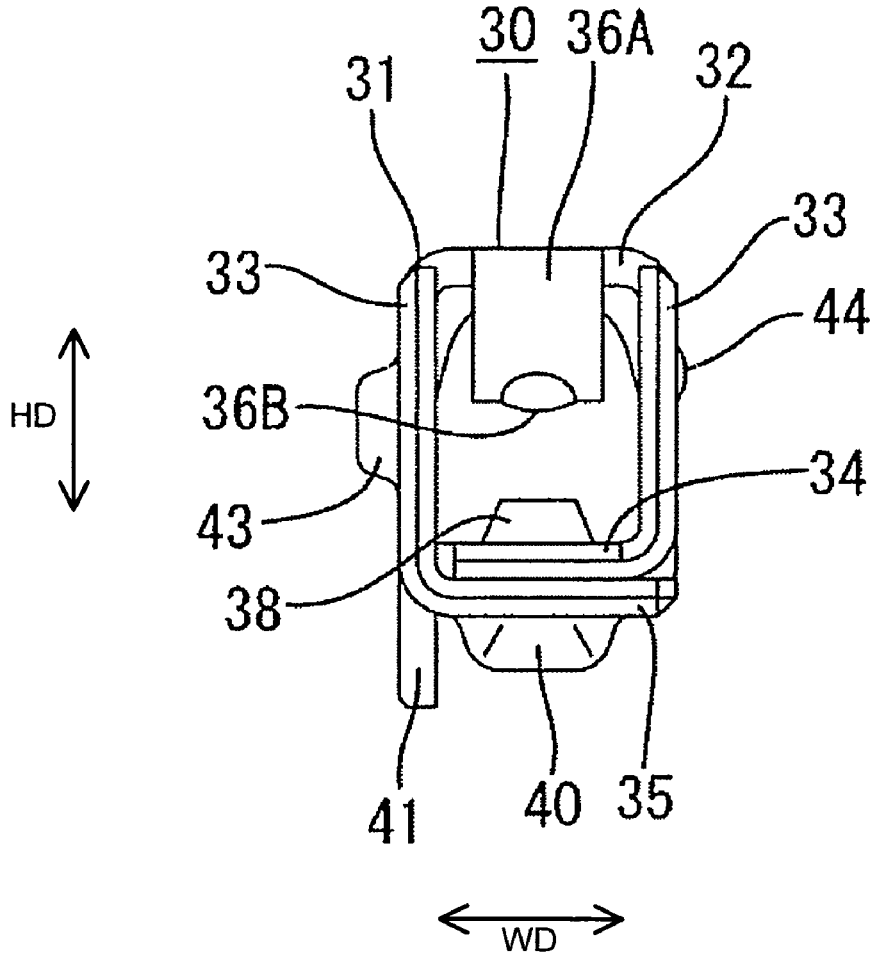
FIG. 11 is a front view of the terminal fitting.

As shown in FIG. 11, the connecting portion 31 has a base plate 32 and two side plates 33 that extend from opposite lateral edges of the base plate 32. An inner projecting plate 34 projects from the projecting end of one side plate 33 to face the base plate 32, and an outer projecting plate 35 projects from the projecting end of the other side plate and is placed on the outer surface of the inner projecting plate 34. The inner and outer projecting plates 34, 35 are placed one over the other to form a double-wall. A resilient contact piece 36 is folded at the front end of the base plate 32 and cantilevers back into the connecting portion 31, as shown in FIG. 10. A deformation support 36A is located at the front end of the base plate 32 and is positioned to face a tab of a male terminal fitting (not shown) in the inserting direction. Thus, the deformation support 36A contacts the tab inserted from the front. A part of the inner projecting plate 34 facing the resilient contact piece 36 is embossed to form an inwardly directed bulge 38 for ensuring a suitable contact pressure with the tab. A space between the bulge 38 and a contact portion 36B of the resilient contact piece 36 opposed to the bulge 38 is slightly smaller than the thickness of the tab when the resilient contact piece 36 is in its natural state.

Figure 7:
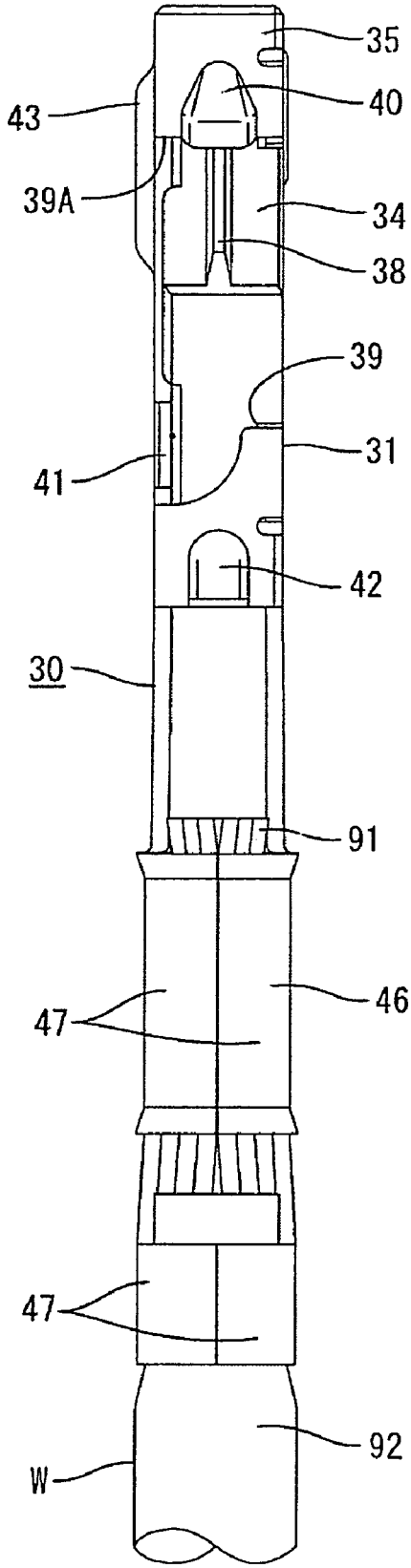
FIG. 7 is a bottom view of the terminal fitting.
Figure 8:
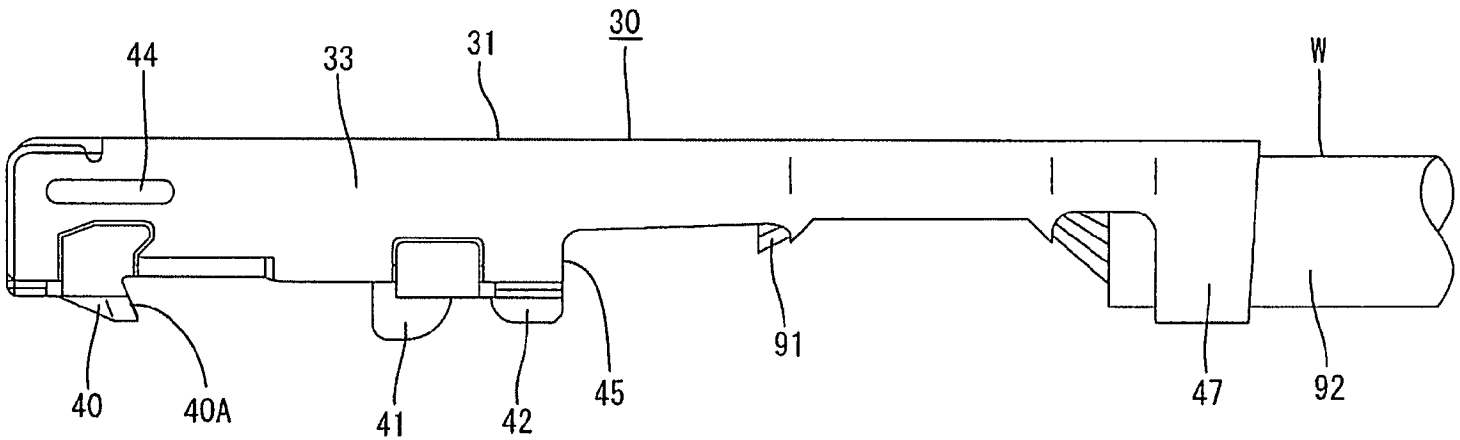
FIG. 8 is a left side view of the terminal fitting.
Figure 9:
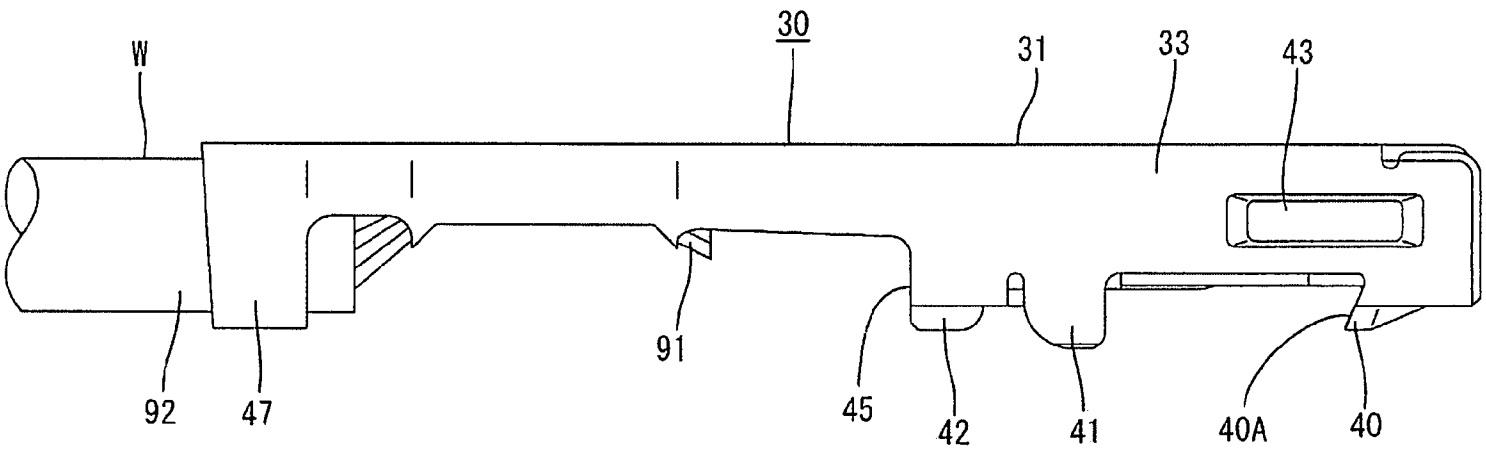
FIG. 9 is a right side view of the terminal fitting.

As shown in FIG. 7, an intermediate part of the outer projecting plate 35 is cut to form a locking hole 39. The locking hole 39 has a length of more than about half, preferably about two thirds of the entire length of the connecting portion 31 and has a width substantially equal to the entire width of the connecting portion 31. A front edge 39A of the locking hole 39 in the outer projecting plate 35 is embossed or cut and bent to form an outwardly projecting protrusion 40 substantially in the form of a half cone that tapers towards the front end. The rear end surface of the protrusion 40 is formed into an engaging surface 40A sloped back toward its bottom end. The engaging surface 40A and the front edge 39A of the locking hole 39 form an engaging section.

A stabilizer 41 projects out along the side plate 33 at a rear side of the lateral edge of the outer projecting plate 35. As shown in FIG. 7, the stabilizer 41 is formed by making a quarter circular cut from the outer projecting plate 35 to the other side plate 33 and bending this cut piece to stand up substantially at a right angle. An intermediate part of the rear end of the outer projecting plate 35 is embossed or cut and bent at a position lying within a range of projection of the protrusion 40 when viewed from front to form a first guiding projection 42 substantially in the form of a half cone. On the other hand, a front end portion of the side plate 33 is embossed out to form a substantially rectangular second guiding projection 43 for preventing loose movements of the terminal fitting 30 substantially along height direction HD. A rectangular third guiding projection 44 is embossed at a front end of the one side plate 33. The third guiding projection 44 is narrower than the second guiding projection 43 and is slightly higher than the second guiding projection 43 along the height direction HD. A jaw 45 is provided at the rear end of the connecting portion 31 and is substantially continuous and substantially flush with the rear surface of the first guiding projection 42.

Figure 3:
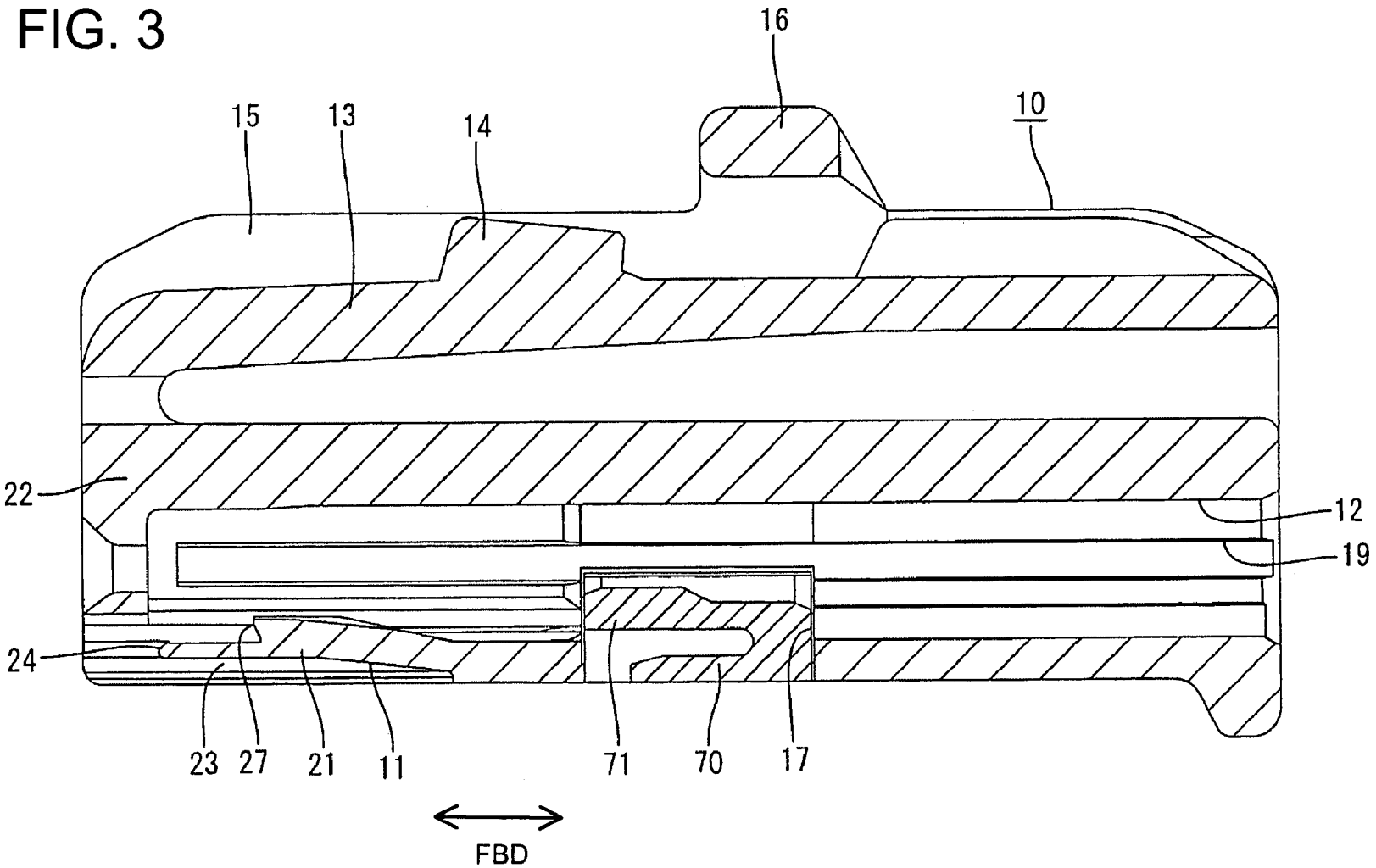
FIG. 3 is a side view in section of a housing.
Figure 6:
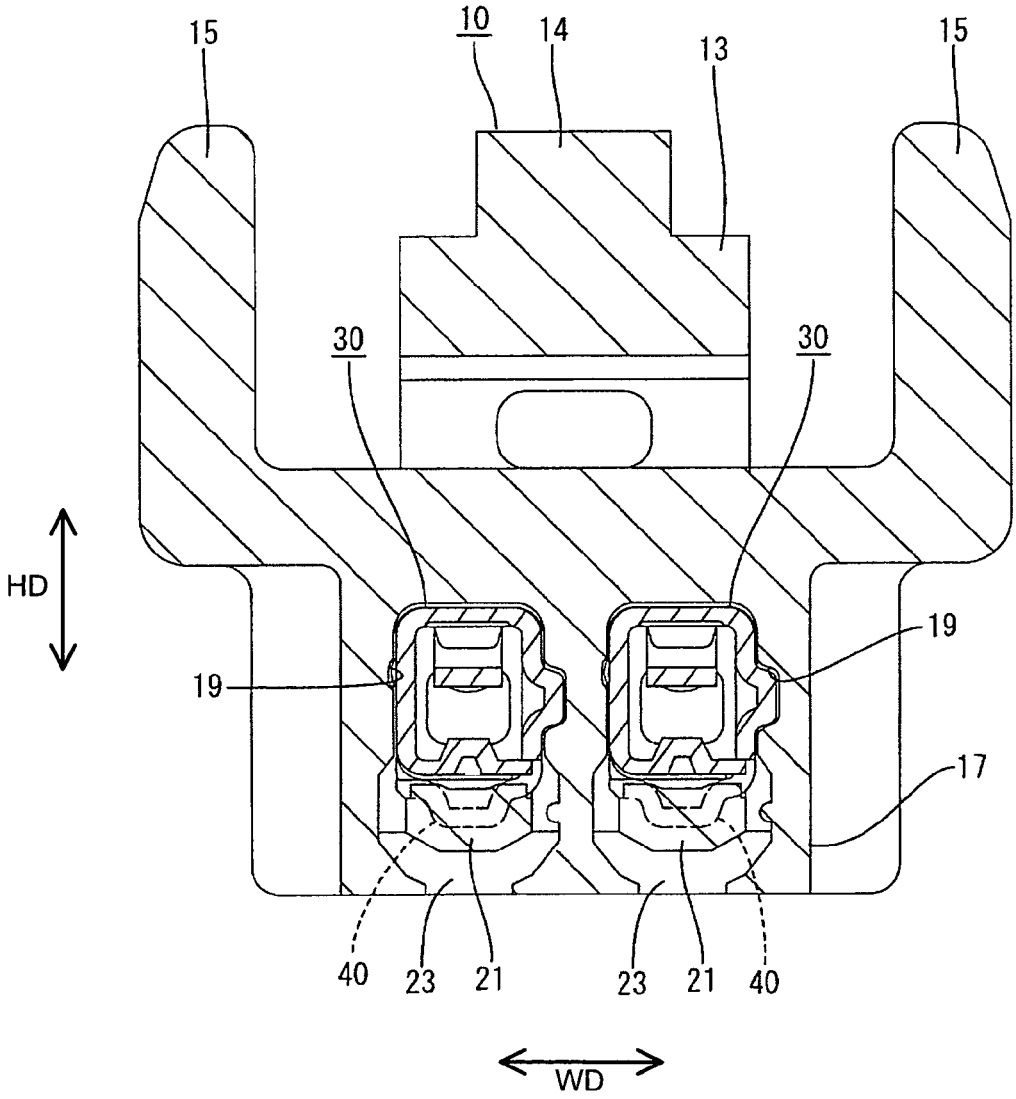
FIG. 6 is a vertical section of the housing and the terminal fitting.

As shown in FIGS. 3 and 6, the housing 10 is made e.g. of a synthetic resin into a substantially block shape, and cavities 12 are provided in the housing 10 for accommodating the terminal fittings 30. A lock arm 13 extends back from the front end of the upper surface of the housing 10, and is resiliently deformable towards and away from the housing 10. A lock projection 14 projects from the upper surface of the lock arm 13 and is engageable with the male connector housing. Two protection walls 15 project from the opposite lateral edges of the upper surface of the housing 10 to protect the lock arm 13 from external forces. Opposite lateral edges of the rear end of the lock arm 13 are coupled to the inner surfaces of the corresponding protection walls 15. As a result, the lock arm 13 is supported at three points. The protection walls 15 are coupled to each other by a bridge 16 that spans at a position behind the lock projection 14 to reinforcing the coupled portions.

A retainer mount hole 17 is open in the bottom and the opposite side surfaces of the housing and communicates with the cavities 12. A retainer 70 is mountable into the retainer mount hole 17, so that inner side surfaces of the retainer 70 are movable along the opposite side surfaces of the housing 10. The retainer 70 has locking projections 71 disposed to engage the jaws 45 of the terminal fittings 30 inserted to a substantially proper depth in the cavities 12. The retainer 70 is movable between a full locking position where the locking projections 71 enter the cavities 12 to retain the terminal fittings 30 and a partial locking position where the locking projections 71 are retracted from the cavities 12 to permit the insertion and withdrawal of the terminal fittings 30.

The cavities 12 are arranged substantially side by side along the width direction WD in the housing 10, so that the connector has a small size. An insertion groove 18 is formed at the lateral edge of the inner bottom surface of each cavity 12 along which the stabilizer 41 of the terminal fitting 30 is at inserted into the cavity 12. As shown in FIG. 1, the insertion groove 18 extends along forward and backward directions FBD and opens in the rear end surface of the housing 10. As shown in FIGS. 3 and 6, a guiding groove 19 is formed in an inner side surface of the cavity 12 substantially parallel with the insertion groove 18 for receiving the second and third guiding projections 43, 44.

As shown in FIG. 1, a U-shaped channel 20 is formed in the inner bottom surface of the cavity 12. A lock 11 also is provided at the inner lateral bottom surface of the cavity 12 and is engageable with the properly inserted terminal fitting 30. The lock 11 is formed by cutting an area of the bottom wall of the housing 10 before the retainer mount hole 17, and includes an arm 21 that extends substantially along forward and backward directions FBD.

The arm 21 has a rear end coupled to the front end of the insertion groove 18 in the inner bottom surface of the cavity 12 and a front end coupled to a front wall 22 of the housing 10. Thus, the arm 21 is supported at both ends to provide high strength. Portions of the arm 21 between the front and rear supports are resiliently deformable outwardly in a deforming direction DD that is substantially normal to the inserting direction of the terminal fitting 30 into the cavity 12. Accordingly, the arm 21 is retractable into a deformation space 23 below the arm 21. The resiliently deformed arm 21 takes a substantially arch shape in which an intermediate portion along forward and backward directions FBD is at a bottommost position. These intermediate parts of the arm 21 are displaced substantially straight and vertically along the deforming direction DD as the arm 21 deforms.

Figure 4:
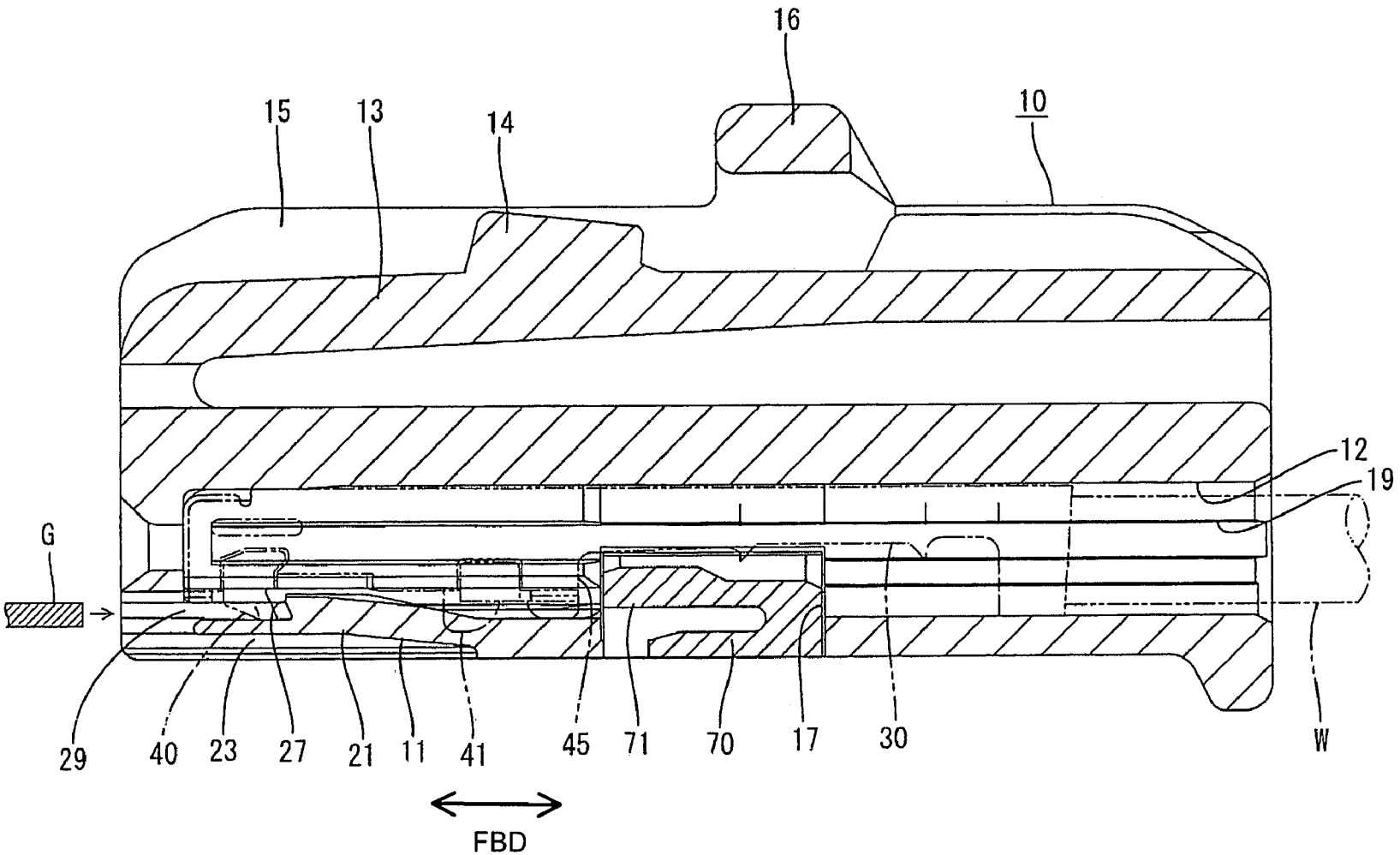
FIG. 4 is a side view in section of the housing having the terminal fitting accommodated therein.

The deformation space 23 is open in the bottom surface of the housing 10. As shown in FIG. 4, a jig insertion hole 29 is formed in the front surface of the housing 10 and communicates with the deformation space 23. Thus, the leading end of a disengagement jig G is insertable from the front through the jig insertion hole 29 and between the terminal fitting 30 and the lock 11. The disengagement jig J can press the arm 21 down in the deforming direction DD to deform the lock 11. A guiding surface 24 slopes up along an inserting direction of the disengagement jig G is in the widthwise middle of the front end of the arm 21 to guide the disengagement jig G rearwardly beyond the jig insertion hole 29. A front end portion of the arm 21 is forked due to the removal of a mold for forming the guiding surface 24, and both divided ends are coupled to the opposite inner side surfaces of the cavity 12. However, the rear of the arm 21 is coupled to the inner bottom surface of the cavity 12 at one position over substantially the entire width of the arm portion 21. Thus, the arm portion 21 is supported at three points.

Figure 5:
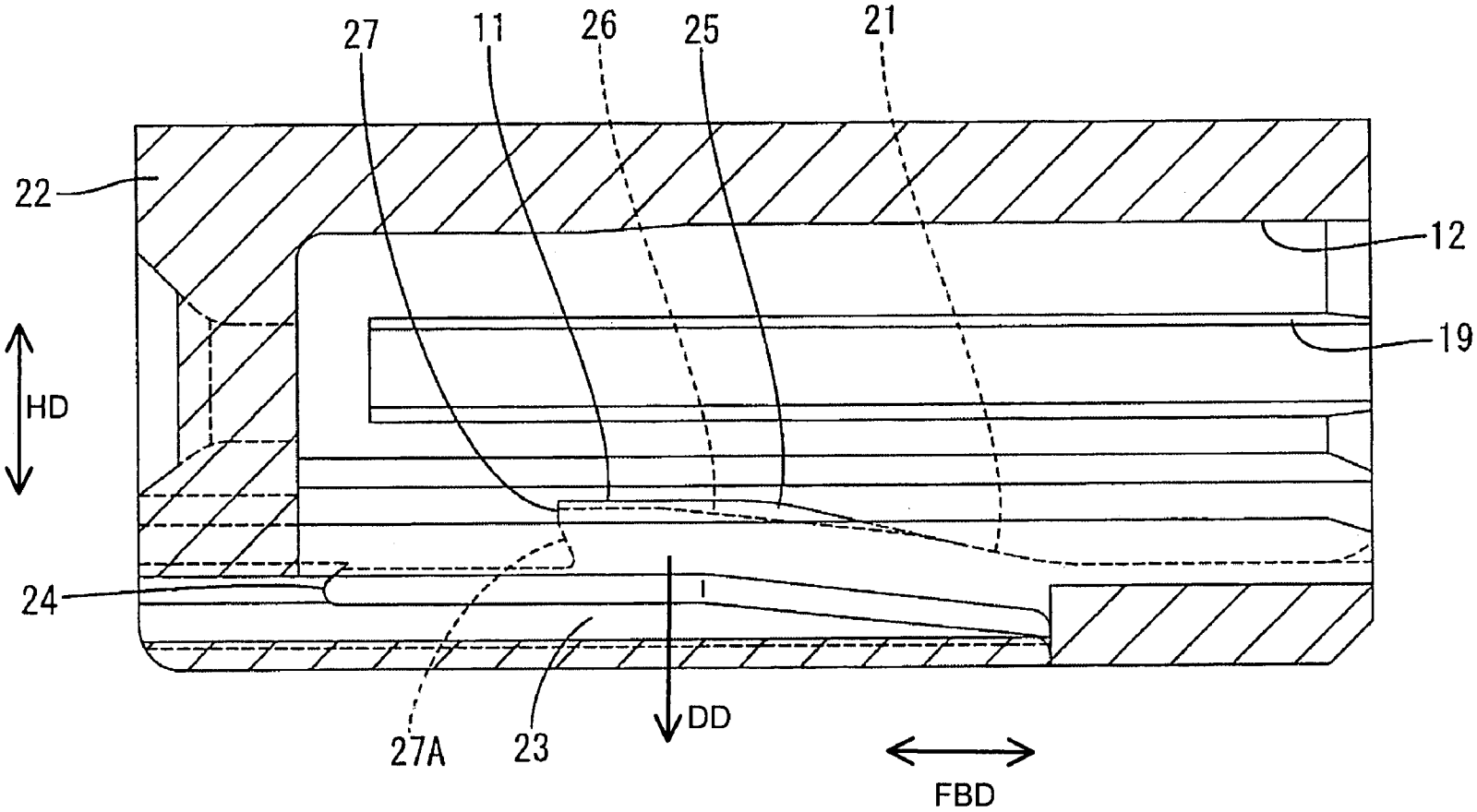
FIG. 5 is a side view in section showing an inner wall of a cavity.

A raised portion 25 is provided on the upper surface of the arm 21 and is slightly narrower than the arm 21. Additionally, the raised portion 25 has a moderate upward inclination from the rear end of the arm 21 to an intermediate position towards the front end. A groove 26 opens in the front surface of the raised portion 25 and extends substantially in forward and backward directions FBD along a middle part of the upper surface of the raised portion 25. The protrusion 40 of the terminal fitting 30 can enter the groove 26 when the terminal fitting 30 is inserted to a proper depth in the cavity 12. A locking section 27 is formed at the front end of the raised portion 25 and engages the projecting end of the protrusion 40 that has entered the groove 26. The locking section 27 is formed over substantially the entire width of the raised portion 25, and a locking surface 27A slopes down and back at the lower part of the locking section 27, as shown in FIG. 5. The locking surface 27A of the locking section 27 and the engaging surface 40A of the protrusion 40 contact each other along an oblique direction that intersects a withdrawing direction of the terminal fitting 30 to strengthen the engagement of the lock 11 with the terminal fitting 30.

An escaping recess 28 is formed at an edge of the arm 21 behind the locking section 27 and overlaps the locking section 27 with respect to the width direction WD. The escaping recess 28 is substantially continuous with the insertion groove 18 and permits insertion of the stabilizer 41. The escaping recess 28 penetrates the rear edge of the arm 21 along the height direction HD, and an end surface 28A of the escaping recess 28 extends substantially vertically and normal to the insertion and withdrawal direction of the terminal fitting 30. The end surface 28A is slightly behind the rear end of the groove 26.

The connector is assembled by mounting the retainer 70 at the partial locking position in the housing 10. The terminal fittings 30 then are inserted into the respective cavities 12 from behind and along an insertion direction. As a result, the stabilizer 41 slides in contact with the inner side surfaces of the insertion groove 18 and the protrusion 40 slides in contact with the inner side surfaces of the channel 20 so that the terminal fitting 30 moves smoothly into the cavity 12. A lower part of the front end of the connecting portion 31 moves onto the upper surface of the raised portion 25 of the lock 11 when the terminal fitting 30 is inserted to a specified depth. Thus, the arm 21 is deformed down in the deforming direction DD. The protrusion 40 enters the groove 26 and the bottom end of the protrusion 40 presses the bottom surface of the groove 26 down in the deforming direction DD as the insertion of the terminal fitting 30 progresses. During this time, the protrusion 40 slides in contact with the groove 26 to prevent shaking of the terminal fitting 30 in the width direction WD. The second and third guiding projections 43, 44 also slide in contact with the inner side surfaces of the guiding groove 19.

Figure 2:
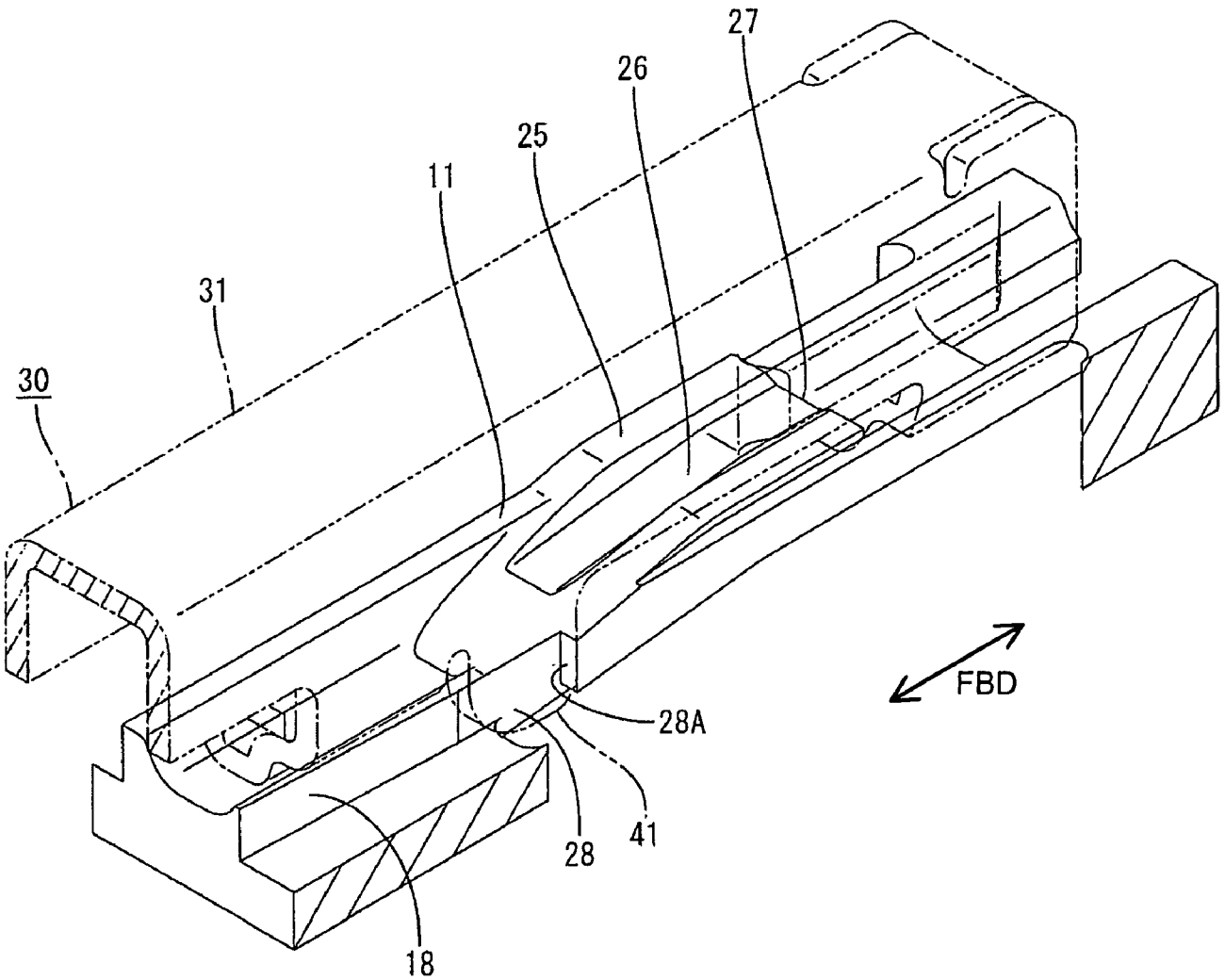
FIG. 2 is a perspective view showing an essential portion of the lock engaged with the terminal fitting.

The raised portion 25 enters the locking hole 39 of the connecting portion 31 when the terminal fitting 30 is inserted to a proper depth. Thus, the arm 21 is restored resiliently, and the locking section 27 engages both the engaging surface 40A of the protrusion 40 and the front edge 39A of the locking hole 39 over substantially the entire width to partly lock the terminal fitting 30, as shown in FIGS. 2, 4 and 6. The stabilizer 41 starts entering the escaping recess 28 of the arm 21 from the insertion groove 18 before the terminal fitting 30 reaches the proper depth. The stabilizer 41 is near the end surface 28A of the escaping recess 28 when the terminal fitting 30 reaches the proper depth.

The retainer 70 is moved from the partial locking position to the full locking position after the terminal fittings 30 have been inserted into the cavities 12. Thus, the locking projections 71 of the retainer 70 engage the jaws 25 of the connecting portions 31 to lock the terminal fittings 30 fully. As a result, the terminal fittings 30 are held securely in the cavities 12 and will not come out. Thereafter, the unillustrated mating male housing is connected with the housing 10, and the tabs of the male terminal fittings in the male housing enter the connecting portions 31 to contact the resilient contact pieces 36 so that the male and female terminal fittings are connected electrically.

As described above, the locking section 27 of the lock 11 engages the engaging surface 40A of the protrusion 40 and the front edge 39A of the locking hole 39 in the connecting portion 31 of the terminal fitting 30 over substantially the entire width to ensure a wide area of engagement. This increases a terminal holding force and makes the construction stronger against shear forces.

The escaping recess 28 for permitting entry of the stabilizer 41 is formed in a part of the lock 11 behind the locking section 27 and overlaps at least part of the locking section 27 with respect to width direction WD. Thus, interference of the stabilizer 41 and the lock 11 is avoided without enlarging the connector.

The escaping recess 28 reduces the rigidity of the rear support of the lock 11. However, the lock 11 preferably is supported at both front and rear ends to increase the strength of the lock 11.

The wires W connected with the terminal fittings 30 have a small diameter in a small connector and may buckle when the terminal fittings 30 are inserted into the cavities 12. However, the escaping recess 28 is at a supporting point for the deformation of the locks 11. Thus, insertion forces are lower and the wires W are less likely to buckle.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although female terminal fittings are described in the foregoing embodiment, the invention is applicable to male terminal fittings.

The stabilizer is provided at the lateral edge at the rear side of the connecting portion in the foregoing embodiment. However, the stabilizer may, for example, be at an intermediate portion of the rear side of the connecting portion according to the invention.

The engaging section engageable with the locking section is formed by the protrusion and the front edge of the locking hole in the foregoing embodiment. However, the engaging section may be formed, for example, only by the front edge of the locking hole according to the present invention.

Although the locking portion is supported at both ends in the foregoing embodiment, the present invention is also applicable to locking portions supported only at one end.

What is claimed is:

1. A connector, comprising:

a connector housing having opposite front and rear ends and at least one cavity extending between the ends, an insertion groove being formed in an inner wall of the cavity and extending forward from the rear end of the housing;

at least one terminal fitting insertable into the cavity in a rear to front direction, a stabilizer projecting from an outer surface of the terminal fitting and receivable in the insertion groove for guiding the terminal fitting into the cavity; and a resiliently deformable lock on an inner wall of the cavity forward of the insertion groove and engageable with the terminal fitting properly accommodated in the cavity, the lock including a locking section engageable with an engaging section of the terminal fitting and an escaping recess formed at a part of the lock rearward of the locking section and at least partly overlapping the locking section with respect to a width direction, the escaping recess being adjacent to, forward of and communicating with the insertion groove and being disposed and dimensioned for receiving the stabilizers.

2. The connector of claim 1, wherein the terminal fitting has a connecting portion for connection with a mating terminal fitting, and wherein the stabilizer projects from an outer surface of the connecting portion.

3. The connector of claim 2, wherein the locking section is engageable with the engaging section provided at the connecting portion over substantially the entire width.

4. The connector of claim 2, wherein the connecting portion is substantially box-shaped, projecting plates at opposite sides of the connecting portion being placed at least partly one inside the other.

5. The connector of claim 4, wherein at least the outer projecting plate is formed with a locking hole over substantially the entire width, and a front edge of the locking hole in the outer projecting plate being embossed to project outward, thereby forming a protrusions.

6. The connector of claim 5, wherein the engaging section includes a rear end of the protrusion and the front edge of the locking hole.

7. The connector of claim 6, wherein the stabilizer projects along a side plate at a lateral edge of the projecting plate behind the locking hole.

8. The connector of claim 1, wherein the lock is supported at both front and rear ends.

9. The connector of claim 8, wherein a front end portion of the lock is forked and is coupled to opposite inner side surfaces of the cavity.

10. The connector of claim 1, wherein a locking surface of the locking section and an engaging surface of the engaging section contact each other along an oblique direction intersecting with a withdrawing direction of the terminal fitting.

11. The connector of claim 1, wherein a guiding groove is formed in an inner side surface of the cavity to be substantially parallel with the insertion groove for receiving the guiding projection.

* * * * *